US011322876B2

(12) United States Patent
Phatiwuttipat et al.

(10) Patent No.: US 11,322,876 B2
(45) Date of Patent: May 3, 2022

(54) CONNECTOR

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Pipatthana Phatiwuttipat, Mie (JP); Yasuo Omori, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/981,960

(22) PCT Filed: Mar. 5, 2019

(86) PCT No.: PCT/JP2019/008488
§ 371 (c)(1),
(2) Date: Sep. 17, 2020

(87) PCT Pub. No.: WO2019/188027
PCT Pub. Date: Oct. 3, 2019

(65) Prior Publication Data

US 2021/0098922 A1 Apr. 1, 2021

(30) Foreign Application Priority Data

Mar. 26, 2018 (JP) ..... JP2018-058387

(51) Int. Cl.
*H01R 13/41* (2006.01)
*H01R 12/58* (2011.01)

(52) U.S. Cl.
CPC ..... *H01R 13/41* (2013.01); *H01R 12/585* (2013.01)

(58) Field of Classification Search
CPC .. H01R 13/24; H01R 13/533; H01R 13/6273; H01R 13/6585; H01R 13/26;
(Continued)

(56) References Cited

U.S. PATENT DOCUMENTS 5,064,391 A 11/1991 Buchter
5,114,362 A * 5/1992 Olsson ..... H01R 12/675 29/857
(Continued)

FOREIGN PATENT DOCUMENTS

JP H09-219270 A 8/1997
JP 2007-280968 A 10/2007
(Continued)

OTHER PUBLICATIONS

International Search Report dated May 28, 2019 for WO 2019/188027 A1 (4 pages).

*Primary Examiner* — Truc T Nguyen
(74) *Attorney, Agent, or Firm* — Abelman, Frayne & Schwab

(57) ABSTRACT

A connector is provided with a housing, a plurality of first terminal fittings, and a plurality of second terminal fittings. The terminal fittings are press-fitted from a rear side of press-fit holes of the housing and arranged to be parallel in a left-right direction. A first projecting part is formed on both left and right edge parts of each of the first terminal fittings, and a second projecting part is formed on both left and right edge parts of each of the second terminal fittings. Each of the projecting parts has a shape where only a portion of the terminal fitting in a length direction projects in the left-right direction, and a pressing surface that is pressed by a jig during press-fitting is formed. The projecting parts of adja-
(Continued)

cent terminal fittings are arranged such that formation positions thereof are not aligned in the front-rear direction.

5 Claims, 4 Drawing Sheets

(58) Field of Classification Search
CPC .... H01R 12/52; H01R 9/0524; H01R 13/422; H01R 2201/16
See application file for complete search history.

(56) References Cited

U.S. PATENT DOCUMENTS

2004/0029428 A1* 2/2004 Wu ..... H01R 13/506 439/357
2004/0029441 A1* 2/2004 Wu ..... H01R 12/7058 439/574
2004/0266229 A1* 12/2004 Li ..... H01R 12/724 439/79
2012/0149228 A1* 6/2012 Matsumoto ..... H01R 13/4223 439/329
2014/0349495 A1* 11/2014 Masuda ..... H01R 13/6587 439/108

FOREIGN PATENT DOCUMENTS

JP 2011-142108 A 7/2011
WO 2018/039351 A1 3/2018

* cited by examiner

CONNECTOR

CROSS REFERENCE TO RELATED APPLICATIONS

This application is a national phase of PCT application No. PCT/JP2019/008488, filed on Mar. 5, 2019, which claims priority from Japanese patent application No. 2018-058387, filed on Mar. 26, 2018, all of which are incorporated herein by reference.

TECHNICAL FIELD

The present invention relates to a connector.

BACKGROUND

A connector mounted on a printed circuit board is conventionally known. As an example of such a connector, Patent Document 1 discloses a circuit board connector provided with a housing and a plurality of terminal fittings arranged in parallel by being press-fitted into press-fit holes of the housing. A projecting part where only a portion in a press-fitting direction projects to both sides of the terminal fittings in the parallel direction is formed on each of the terminal fittings of the circuit board connector. The terminal fittings are press-fitted into the press-fit holes by pressing a rear surface (pressing surface) of the projecting part with a jig. Furthermore, a front surface of the projecting part is positioned by abutting against an inner end surface of a housing recessed part formed on a rear side of the press-fit hole.

Furthermore, during press-fitting, when the jig that presses the projecting part enters the housing recessed part, the jig may cause damage due to contact with an inner surface of the housing recessed part. Therefore, a press fit surface is formed so as to be aligned with an opening edge of the housing recessed part in a front-rear direction or to be disposed on a rear side of the housing recessed part, in a condition where the terminal fitting is positioned in the press-fitting direction.

PRIOR ART DOCUMENT

Patent Document

Patent Document 1: JP 2007-280968A

SUMMARY OF THE INVENTION

Problems to be Solved

In recent years, there has been demand to reduce the parallel pitch of the terminal fittings in order to reduce the size for this connector. However, the pressing surface is exposed at an opening portion of the housing recessed part, and the spatial distance between terminal fittings is the smallest between pressing surfaces. Therefore, when adjacent terminal fittings are brought close to each other, an arc discharge may occur between the pressing surfaces, causing the terminal fittings to short-circuit.

In light of the foregoing, an object of the present invention is to provide technology capable of reducing the parallel pitch of terminal fittings.

Means to Solve the Problem

A connector of the present invention is a connector including:

a housing; and a plurality of terminal fittings press-fitted into press-fit holes of the housing from a rear side and arranged in parallel, wherein each of the terminal fittings includes a shaft part that extends in a front-rear direction and a projecting part formed to project in a width direction from the shaft part, and formation positions of the projecting parts are arranged such that formation positions of two adjacent terminal fittings are not aligned in the front-rear direction.

Effect of the Invention

With the connector of the present invention, the projecting parts of two adjacent terminal fittings are arranged in a non-aligned condition in the front-rear direction. Therefore, the pitch of the terminal fittings can be made smaller than a conventional configuration where the positions of adjacent projecting parts are aligned in the front-rear direction.

Figure 1:
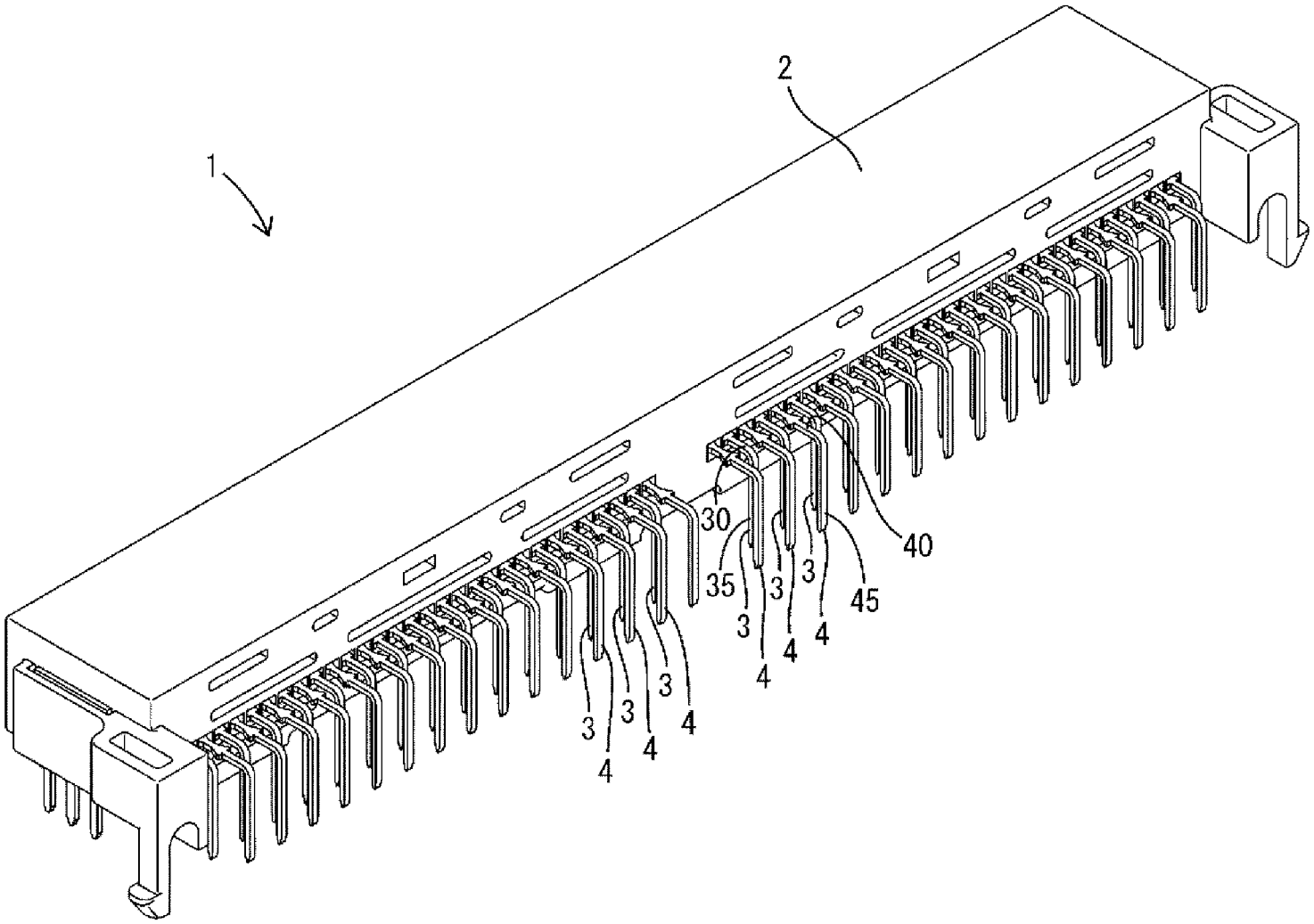
FIG. 1 is a perspective view of a connector of a first embodiment as viewed from an upper rear side.

DETAILED DESCRIPTION TO EXECUTE THE INVENTION (1) In the connector of the present invention, the terminal fittings may be arranged such that a first terminal fitting in which the projecting part is formed on a front side in the front-rear direction and a second terminal fitting in which the projecting part is formed on a rear side in the front-rear direction are adjacent. The projecting part of the second terminal fitting may be inclined inward in the width direction toward a front side.

Thereby, the spatial distance between adjacent projecting parts can be reduced while ensuring the length of the projecting part on the rear side in the front-rear direction to increase strength, as compared to when side edge parts of the projecting part on the rear side are parallel with the press-fitting direction.

(2) In the connector of the present invention, the terminal fittings may be arranged such that a first terminal fitting in which the projecting part is formed on a front side in the front-rear direction and a second terminal fitting in which the projecting part is formed on a rear side in the front-rear direction are adjacent. The projecting part of the second terminal fitting may be inclined inward in the width direction toward a front side. Housing recessed parts that are continuous with rear ends of the press-fit holes and are open at a rear surface of the housing may be formed in the housing. The projecting part of the first terminal fitting may be housed in a corresponding housing recessed part. An abutting part housed in a corresponding housing recessed part and having a shape projecting in the width direction may be formed on the shaft part of the second fitting. The abutting part may be inclined inward in the width direction from an inner side toward an opening side of the corresponding housing recessed part.

The projecting part and the abutting part are housed in adjacent housing recessed parts. However, the abutting part has a shape inclined inward in the width direction from the inner side toward the opening side of the housing recessed part. Thereby, the spatial distance between the abutting part and projecting part in the housing recessed parts can be secured while securing the front-rear dimension of the abutting part and increasing strength.

First Embodiment

A first embodiment embodying the present invention will be described below while referring to FIGS. 1 to 4. Note that with regard to the front-rear direction, a fitting direction (left side in FIG. 2 and lower side in FIGS. 3 and 4) of a connector 1 with respect to a mating connector (not illustrated in the drawings) is defined as a "front side", and an opposite direction thereof is defined as a "rear side". With regard to the vertical direction, the vertical direction in FIG. 2 is defined as the "vertical direction", and with regard to the left-right direction, the left-right direction in FIGS. 3 and 4 is defined as the "left-right direction".

(Connector 1)

Figure 2:
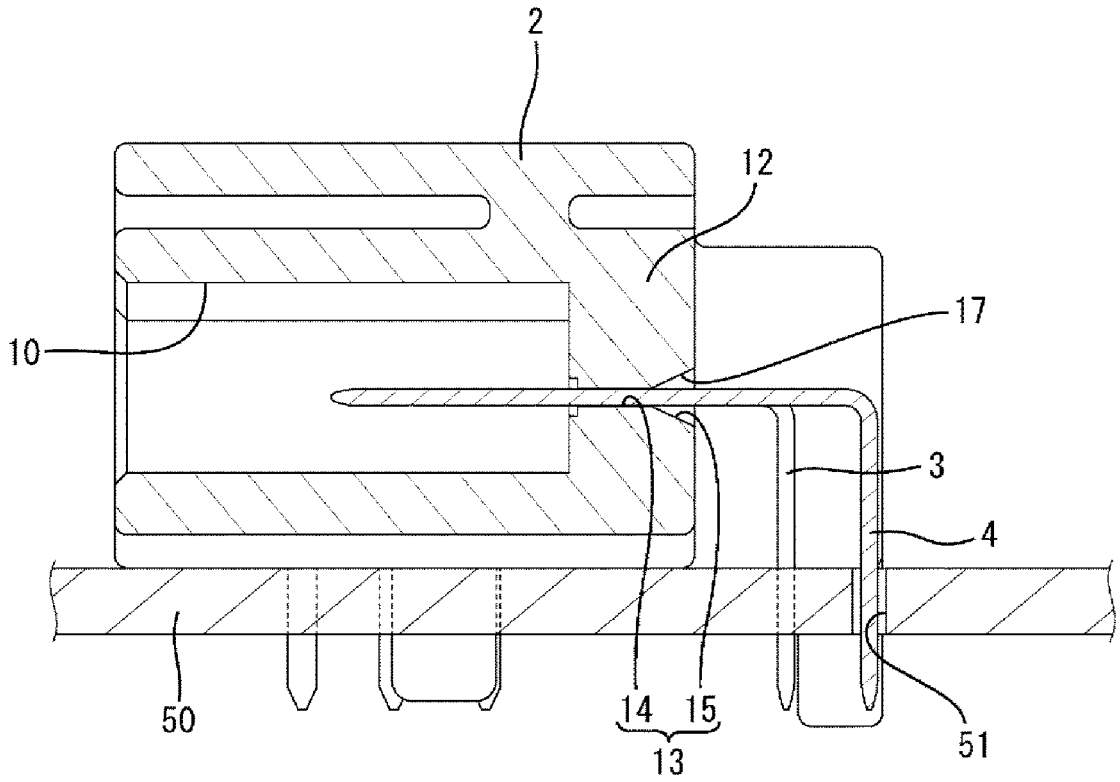
FIG. 2 is a side sectional view of a condition where the connector is mounted to a circuit board.

As illustrated in FIGS. 1 and 2, the connector 1 of the first embodiment is a circuit board connector that is installed and used on a printed circuit board 50. The connector 1 is provided with a housing 2 and a plurality of first terminal fittings 3 and a plurality of second terminal fittings 4 maintained in a condition of being press-fitted into the housing 2.

Figure 3:
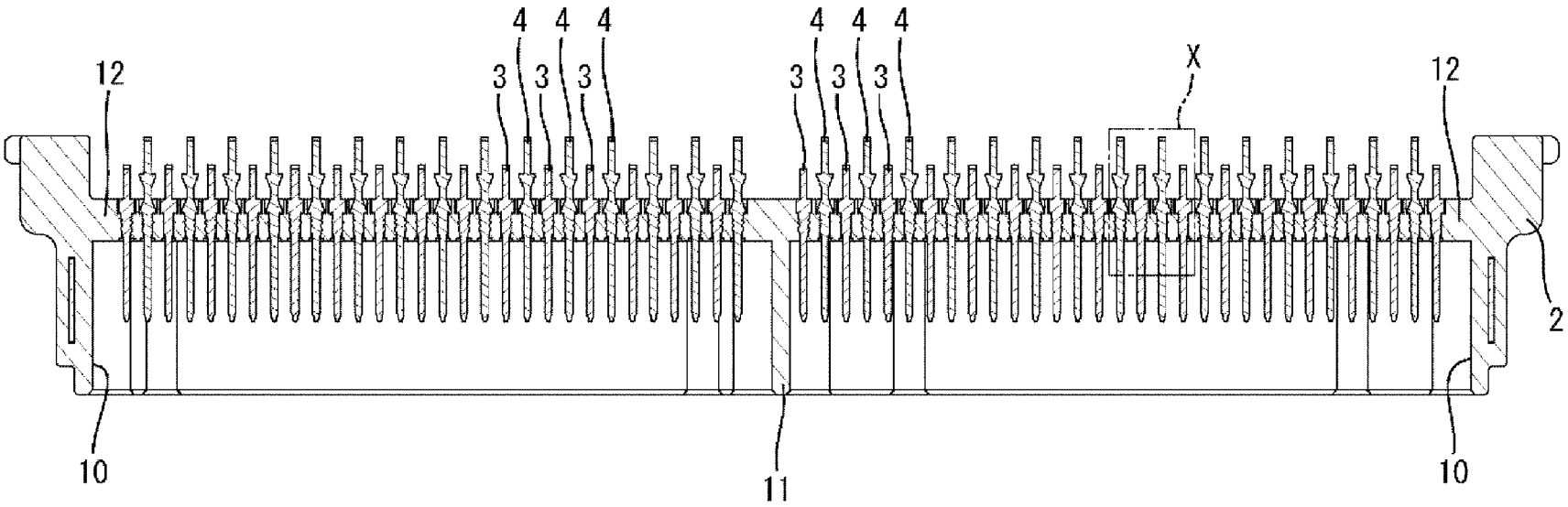
FIG. 3 is a plan sectional view of the connector.
Figure 4:
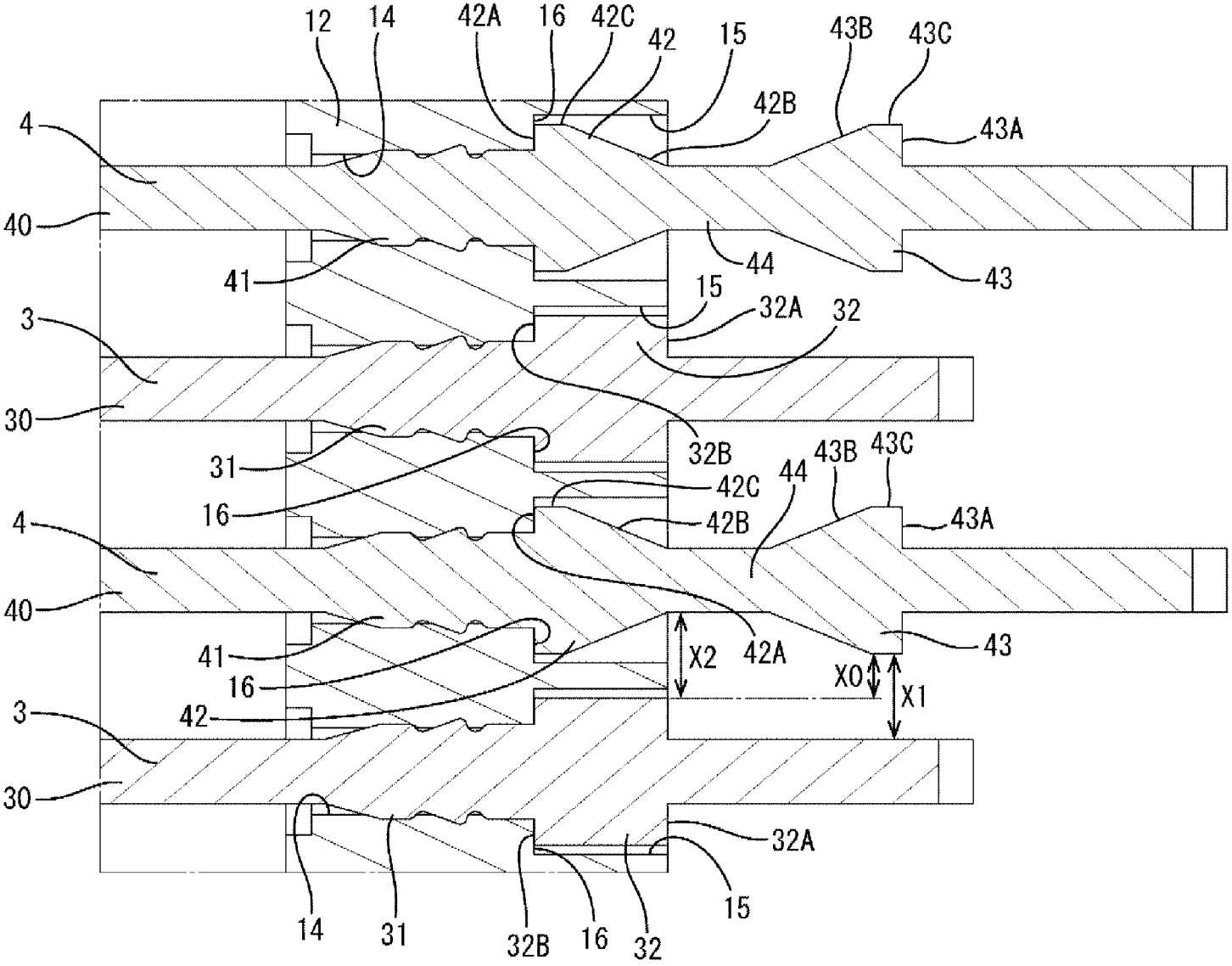
FIG. 4 is an enlarged view of range X in FIG. 3.

As illustrated in FIGS. 1 to 3, the housing 2 is made of a synthetic resin and has a box shape that is long in the left-right direction. A fitting groove 10 having a wide opening is formed on a front surface of the housing 2, and a mating connector (not illustrated in the drawings) is inserted in the fitting groove 10. The fitting groove 10 is divided into left and right portions by a partition wall 11. Both left and right surfaces and both upper and lower surfaces of the fitting groove 10 are closed over the entire region. A back surface of the fitting groove 10 is closed by a rear wall part 12 of the housing 2.

A plurality of mounting holes 13 penetrating in the front-rear direction are formed in the rear wall part 12. The plurality of mounting holes 13 are formed so as to be aligned parallel in the left-right direction. All mounting holes 13 are arranged in a line. Each mounting hole 13 includes a press-fit hole 14 and a housing recessed part 15 formed on a rear side of the mounting hole 14. Each press-fit hole 14 has a long and thin shape in the front-rear direction, and is formed such that the width dimension is larger than the height dimension.

As illustrated in FIG. 4, the housing recessed part 15 is open at a rear surface of the housing 2 (rear wall part 12), and is in communication with the press-fit hole 14. The housing recessed part 15 is formed such that the width dimension thereof is larger than that of the press-fit hole 14, and at least a portion (in the first embodiment, portion in communication with opening edges on both left and right sides of the press-fit hole 14) forms a step with the press-fit hole 14. A regulating surface 16 that regulates movement of the terminal fittings 3 and 4 in the press-fitting direction is formed on the step portion. The regulating surface 16 is orthogonal to the press-fitting direction of the terminal fittings 3 and 4. A guide surface 17 inclined inward from the opening edge to the inside of the housing recessed part 15 is formed on both upper and lower surfaces of the housing recessed part 15 (refer to FIG. 2).

The terminal fittings 3 and 4 are press-fitted in the press-fit holes 14 from the rear side of the housing 2, and when a predetermined position is reached, press-fitting is completed. This condition is defined as a "normal press-fit condition". In the normal press-fit condition, portions of the terminal fittings 3 and 4 in front of the press-fit hole 14 are arranged in a condition protruding inside the fitting groove 10 toward the front side. Portions of the terminal fittings 3 and 4 behind the press-fit holes 14 are bent downward at right angles. The first terminal fitting 3 and second terminal fitting 4 are bent at positions shifted from each other in the front-rear direction. Bent portions of the terminal fittings 3 and 4 extending downward (printed board connecting parts 35, 45) are soldered in a condition of being inserted in through holes 51 formed on the printed board substrate 50, and are electrically connected to a circuit of the printed circuit board 50. In this manner, the connector 1 is installed on the printed circuit board 50.

(Terminal Fittings 3, 4)

As illustrated in FIG. 4, the terminal fittings 3 and 4 are conductive metal members and have a long and thin shape. The terminal fittings 3 and 4 are symmetrical in the width direction. Both upper and lower surfaces of the terminal fittings 3 and 4 are flush with each other. The first terminal fitting 3 is provided with: a first shaft part 30 with a long and thin shape; a first press-fit part 31 formed only in a portion (center portion) in a length direction of the first shaft part 30; a first projecting part 32 formed on a rear side of the first press-fit part 31; and a first printed board connecting part 35 extending from a rear end part of the first shaft part 30.

The first shaft part 30 has a rectangular cross-sectional shape and is formed such that a tip end part narrows toward an edge. The first shaft part 30 extends in the front-rear direction in the normal press-fit condition.

The first press-fit part 31 is formed on both left and right edge parts of the first terminal fitting 3. The first press-fit part 31 has a configuration where only a portion in the length direction of the first terminal fitting 3 bulges in the left-right direction (parallel direction of the terminal fittings 3 and 4). In other words, the first press-fit part 31 has a configuration that bulges outward in the left-right direction from both left and right surfaces of the first shaft part 30. Furthermore, protrusions and recesses are formed on both left and right surfaces of the first press-fit part 31. Thereby, a maximum width dimension of the first terminal fitting 3 in the portion where the first press-fit part 31 is formed is larger than the width dimension of the press-fit hole 14. A height dimension of the first press-fit part 31 is the same as or slightly smaller than the height dimension of the press-fit hole 14.

The first projecting part 32 is formed on both left and right edge parts of the first terminal fitting 3. The first projecting part 32 has a configuration where only a portion in the length direction of the first terminal fitting 3 projects in the left-right direction (parallel direction of the terminal fittings 3 and 4). In other words, the first projecting part 32 has a configuration that projects outward in the left-right direction (width direction) from both left and right surfaces of the first shaft part 30. Both left and right surfaces of the first projecting part 32 are formed parallel with the press-fitting direction, and have a rectangular shape in plan view. Thereby, the portion of the first terminal fitting 3 where the first projecting part 32 is formed has a rectangular shape in plan view. A width dimension of the first terminal fitting 3 in the portion where the first projecting part 32 is formed is smaller than the width dimension of the housing recessed part 15, and is larger than the maximum width dimension of the first terminal fitting 3 in the portion where the first press-fit part 31 is formed. A height dimension of the first terminal fitting 3 in the portion where the first projecting part 32 is formed is the same as or slightly smaller than the height dimension of the press-fit hole 14. A first press fit surface 32*a* against which a jig (not illustrated in the drawings) is pressed during press-fitting is formed on a rear surface of the first projecting part 32. A first abutting surface 32B that abuts against the regulating surface 16 during press-fitting is formed on a front surface of the first projecting part 32. In other words, the first projecting part 32 also functions as an abutting part that abuts against the regulating surface 16 during press-fitting. Note that the first press fit surface 32A and first abutting surface 32B are orthogonal to the press-fitting direction (first shaft part 30).

The first printed board connecting part 35 is a portion for connection to the printed circuit board 50, and extends from the rear end part of the first shaft part 30. The first printed board connecting part 35 has a long and thin shape, and the cross-sectional shape and size are the same as the cross-sectional shape and size of the first shaft part 30. The first printed board connecting part 35 extends in the vertical direction in the normal press-fit condition.

The first terminal fitting 3 is inserted into the press-fit hole 14 by pressing the first press fit surface 32A with the jig (not illustrated in the drawings). Furthermore, when press-fitted into the press-fit hole 14, the first press-fit part 31 is maintained in the housing 2 by an anchoring effect and frictional force generated between the first press-fit part 31 and press-fit hole 14. Furthermore, when the first abutting surface 32B abuts against the regulating surface 16, the normal press-fit condition is achieved. In the normal press-fit condition of the first terminal fitting 3, the first projecting part 32 is housed in the housing recessed part 15, and the first press fit surface 32A is aligned with the opening edge of the housing recessed part 15 in the front-rear direction or arranged more rearward than the opening edge of the housing recessed part 15. In the first terminal fitting 3, a portion (connecting portion between the first shaft part 30 and first printed board connecting part 35) that is more rearward than the first press fit surface 32A is bent downward.

The second terminal fitting 4 is provided with: a second shaft part 40 with a long and thin shape; a second press-fit part 41 formed only in a portion (center portion) in the length direction of the second shaft part 40; an abutting part 42 formed on a rear side of the second press-fit part 41; a second projecting part 43 formed on a rear side of the abutting part 42; and a second printed board connecting part 45.

Configurations of the second shaft part 40, the second press-fit part 41, and the second printed board connecting part 45 are the same as the configurations of the first shaft part 30, the first press-fit part 31, and the first printed board connecting part 35, respectively, and therefore, descriptions thereof will be omitted.

The abutting part 42 is formed on both left and right edge parts of the second terminal fitting 4. The abutting part 42 has a configuration where only a portion in the length direction of the second terminal fitting 4 projects in the left-right direction (parallel direction of the terminal fittings 3 and 4). In other words, the abutting part 42 has a configuration that projects outward in the left-right direction (width direction) from both left and right surfaces of the second shaft part 40. A second abutting surface 42A that abuts against the regulating surface 16 during press-fitting is formed on a front surface of the abutting part 42. The second abutting surface 42A is orthogonal to the press-fitting direction (second shaft part 40). On both left and right surfaces of the abutting part 42, a front sloped edge part 42B inclined inward in the width direction toward the rear side is formed in the portion other than the front end part, and a front parallel edge part 42C that is parallel with the press-fitting direction is formed on the front end part. The front sloped edge part 42B is gently inclined relative to the second shaft part 40 (press-fitting direction). In the front sloped edge part 42B, a projecting dimension in the parallel direction of the terminal fittings 3 and 4 gradually decreases toward the rear side. The abutting part 42 is approximately triangular in plan view. The portion of the second terminal fitting 4 where the abutting part 42 is formed is approximately isosceles trapezoidal in plan view. A front-rear dimension of the abutting part 42 is the same as the front-rear dimension of the housing recessed part 15 or smaller than that of the housing recessed part 15. A maximum width dimension of the second terminal fitting 4 in the portion where the abutting part 42 is formed is smaller than the width dimension of the housing recessed part 15, and is larger than the maximum width dimension of the second terminal fitting 4 in the portion where the second press-fit part 41 is formed. A height dimension of the second terminal fitting 4 in the portion where the abutting part 42 is formed is the same as or slightly smaller than the height dimension of the press-fit hole 14. Note that a pressing surface that is pressed with a jig is not formed in the abutting part.

The second projecting part 43 is formed on both left and right edge parts of the second terminal fitting 4. The second projecting part 43 is symmetrical with the abutting part 42 in the front-rear direction. In other words, the second projecting part 43 has a configuration where only a portion in the length direction of the second terminal fitting 4 projects in the left-right direction (parallel direction of the terminal fittings 3 and 4). Furthermore, the second projecting part 43 has a configuration that projects outward in the left-right direction (width direction) from both left and right surfaces of the second shaft part 40. A second press fit surface 43*a* against which a jig (not illustrated in the drawings) is pressed during press-fitting is formed on a rear surface of the second projecting part 43. The second press fit surface 43A is orthogonal to the press-fitting direction (second shaft part 40). On both left and right surfaces of the second projecting part 43, a rear sloped edge part 43B inclined inward in the left-right direction toward the front side is formed in the portion other than the rear end part, and a rear parallel edge part 43C that is parallel with the press-fitting direction is formed on the rear end part. The rear sloped edge part 43B is gently inclined relative to the second shaft part 40 (press-fitting direction). In the rear sloped edge part 43B, a projecting dimension in the parallel direction of the terminal fittings 3 and 4 gradually decreases toward the front side. The second projecting part 43 is approximately triangular in plan view. The portion of the second terminal fitting 4 where the second projecting part 43 is formed is approximately isosceles trapezoidal in plan view. A height dimension of the second terminal fitting 4 in the portion where the second projecting part 43 is formed is the same as the height dimension of the press-fit hole 14 or slightly smaller than the height dimension of the press-fit hole 14. Note that an abutting surface that abuts against the regulating surface 16 during press-fitting is not formed on second projecting part 43.

An intermediate part 44 connected to the abutting part 42 and the second projecting part 43 is formed between the abutting part 42 and the second projecting part 43. The intermediate part 44 has the same cross-sectional shape and size as the second shaft part 40. In other words, a width dimension of the intermediate part 44 is smaller than the maximum width dimension of the abutting part 42, and smaller than the maximum width dimension of the second projecting part 43. A front-rear dimension of the intermediate part 44 is approximately the same as that of the abutting part 42 and the second projecting part 43 or smaller than that of the abutting part 42 and the second projecting part 43.

The second terminal fitting 4 is inserted into the press-fit hole 14 by pressing the second press fit surface 43A with the jig (not illustrated in the drawings). Furthermore, when press-fitted into the press-fit hole 14, the second press-fit part 41 is maintained in the housing 2 by an anchoring effect and frictional force generated between the second press-fit part 41 and the press-fit hole 14. Furthermore, when the second abutting surface 42A abuts against the regulating surface 16, the normal press-fit condition is achieved. In the normal press-fit condition, the rear edge of the abutting part 42 is aligned with the opening edge of the housing recessed part 15 in the front-rear direction or arranged more forward than the opening edge of the housing recessed part 15. In other words, the entire abutting part 42 is housed in the housing recessed part 15. The second projecting part 43 is arranged in a condition where the second press fit surface 43A is arranged more rearward than the opening edge of the housing recessed part 15 and at least a portion is exposed outside of the housing recessed part 15. The intermediate part 44 is arranged in a condition where at least a portion is exposed outside of the housing recessed part 15. In the second terminal fitting 4, a portion (connecting portion between the second shaft part 40 and second printed board connecting part 45) that is more rearward than the second projecting part 43 is bent downward. The position where the second terminal fitting 4 is bent is more rearward than the position where the first terminal fitting 3 is bent.

The first terminal fitting 3 and the second terminal fitting 4 are alternatingly arranged in the left-right direction. Therefore, adjacent first terminal fittings 3 and second terminal fittings 4 are arranged with the following relationship. The projecting parts 32 and 43 of adjacent terminal fittings 3 and 4 are arranged such that the formation positions thereof are not aligned in the front-rear direction. In other words, the first projecting part 32 formed on the first terminal fitting 3 is arranged on the front side in the front-rear direction, and the second projecting part 43 formed on the second terminal fitting 4 is arranged on the rear side in the front-rear direction. More specifically, a portion of the second projecting part 43 on the rear side that is projecting the most is arranged more rearward than a portion of the first projecting part 32 on the front side that is projecting the most. Thereby, a minimum spatial distance X1 between the second projecting part 43 and first terminal fitting 3 is larger than a minimum spatial distance X0 in the case where the projecting parts 32 and 43 are arranged at positions aligned in the front-rear direction. Furthermore, out of the projecting parts 32 and 34, the rear sloped edge part 43B formed on both left and right edge parts of the rear-side second projecting part 43 is inclined inward in the width direction toward the front side. Thereby, a gap (spatial distance) between the rear sloped edge part 43B of the second projecting part 43 on the rear side and the adjacent first terminal fitting 3 gradually increases toward the front side. As a result, the second projecting part 43 on the rear side can be moved to the front side while securing a large spatial distance between the projecting parts 32 and 43. Therefore, large spatial distance between the projecting parts 32 and 43 can be secured while preventing the intermediate part 44 from buckling when pressed. Furthermore, the front edge of the second projecting part 43 on the rear side is arranged rearward of the first projecting part 32 on the front side.

Furthermore, the abutting part 42 of the second terminal fitting 4 is housed inside the housing recessed part 15, and the front sloped edge part 42B formed on both left and right edge parts thereof is inclined inward in the width direction from the inner side of the housing recessed part 15 toward the opening side. Thereby, a minimum spatial distance X2 between the abutting part 42 and first terminal fitting 3 is larger than a minimum spatial distance X0 in the case where the portion of the abutting part 42 (second projecting part 43) that is projecting the most and the first projecting part 32 are arranged at positions aligned in the front-rear direction.

(Function and Effect of First Embodiment)

The connector 1 of the first embodiment is provided with the housing 2, the plurality of first terminal fittings 3, and the plurality of second terminal fittings 4. The first terminal fittings 3 each include the first shaft part 30 that extends in the front-rear direction and the first projecting part 32 formed to project in the width direction from the first shaft part 30. The second terminal fittings 4 each include the second shaft part 40 that extends in the front-rear direction and the second projecting part 43 formed to project in the width direction from the second shaft part 40. In a first terminal fitting 3 and a second terminal fitting 4 that are adjacent, the formation position of the first projecting part 32 of the first terminal fitting 3 and the formation position of the second projecting part 43 of the second terminal fitting 4 are arranged so as to not be aligned in the front-rear direction.

According to the connector 1, the projecting parts 32 and 43 of two adjacent terminal fittings 3 and 4 are arranged in a non-aligned condition in the front-rear direction. Therefore, the pitch of the terminal fittings 3 and 4 can be made smaller than a conventional configuration where the positions of adjacent projecting parts 32 and 43 are aligned in the front-rear direction.

Furthermore, in the connector 1 of the first embodiment, the first terminal fitting 3 in which the first projecting part 32 is formed on the front side in the front-rear direction and the second terminal fitting 4 in which the second projecting part 43 is formed on the rear side in the front-rear direction are arranged in an adjacent manner. Furthermore, the second projecting part 43 of the second terminal fitting 4 is inclined inward in the width direction toward a front side.

Thereby, the spatial distance between adjacent projecting parts 32 and 43 can be reduced while securing the length of the second projecting part 43 on the rear side in the front-rear direction to increase strength, compared to when both left and right edge parts of the second projecting part 43 on the rear side are parallel with the press-fitting direction.

Furthermore, in the connector 1 of the first embodiment, the first terminal fitting 3 in which the first projecting part 32 is formed on the front side in the front-rear direction and the second terminal fitting 4 in which the second projecting part 43 is formed on the rear side in the front-rear direction are arranged in an adjacent manner. The second projecting part 43 of the second terminal fitting 4 is inclined inward in the width direction toward a front side. The housing recessed parts 15 that are continuous with the rear ends of the press-fit holes 14 and are open at the rear surface of the housing 2 are formed in the housing 2. The first projecting part 32 of the first terminal fitting 3 is housed in a corresponding housing recessed part 15. The abutting part 42 housed in a corresponding housing recessed part 15 and having a shape projecting in the width direction is formed on the second shaft part 40. Both left and right edge parts of the abutting part 42 are inclined inward in the width direction from an inner side to an opening side of the housing recessed part 15.

The first projecting part 32 and the abutting part 42 are housed in adjacent housing recessed parts 15. However, the abutting part 42 has a shape where both left and right edge parts are inclined. Thereby, a large spatial distance can be secured between the abutting part 42 and first projecting part 32 in the housing recessed parts 15 while securing the front-rear dimension of the abutting part 42 to increase strength.

Other Embodiments

The present invention is not limited to the embodiment described in the aforementioned description and the drawings. For example, the following embodiments are also included within the technical scope of the present invention.

(1) In the first embodiment, the first projecting part of the first terminal fitting also functioned as an abutting part. However, as with the second terminal fitting, an abutting part may be provided separately from the first projecting part.

(2) In the first embodiment, a press-fit part of the terminal fitting bulged outward in the left-right direction from both left and right surfaces of the shaft part. However, the press-fit part may bulge from a different surface of the shaft part. For example, bulging in the vertical direction from both upper and lower surfaces of the shaft part is also possible.

(3) In the first embodiment, the maximum width dimension of the abutting part and the maximum width dimension of the projecting part were the same but may also not be the same. However, a spatial distance between adjacent terminal fittings must be secured at a certain distance or more.

(4) In the first embodiment, the first terminal fitting has an abutting surface, but an abutting surface may also not be provided. For example, the front-rear dimension of the projecting part may be smaller than the front-rear dimension of the housing recessed part. In this case, press-fitting (pressing) preferably ends when the jig (pressing surface) reaches the opening edge of the housing recessed part. Thereby, even if the front-rear dimension of the projecting part is smaller than the front-rear dimension of the housing recessed part, the jig entering the housing recessed part can be prevented from causing damage by coming into contact with an inner surface of the housing recessed part. In this case, a condition where pressing is completed is the normal press-fit condition.

LIST OF REFERENCE NUMERALS

1 Connector
2 Housing
3 First terminal fitting
4 Second terminal fitting
13 Mounting hole
14 Press-fit hole
15 Housing recessed part
16 Regulating surface
30 First shaft part (shaft part)
32 First projecting part (projecting part)
32A First press-fit surface
32B First abutting surface
40 Second shaft part (shaft part)
42 Abutting part
42A Second abutting surface
42B Front sloped edge part
43 Second projecting part (projecting part)
43A Second press fit surface
43B Rear sloped edge part

What is claimed is:

1. A connector, comprising:

a housing; and a plurality of terminal fittings including a first terminal fitting and a second terminal fitting, and press-fitted into a plurality of press-fit holes of the housing, respectively, from a rear side, the plurality of terminal fittings being arranged in parallel, wherein the first terminal fitting and the second terminal fitting include a first shaft part and a second shaft part that extend in a front-rear direction, respectively, and a first projecting part and a second projecting part that are formed to project in a width direction from the first shaft part and the second shaft part, respectively, and the first terminal fitting and the second terminal fitting are alternately arranged in a longitudinal direction of the housing in a state where the plurality of terminal fittings are press-fitted into the press-fit holes, respectively, such that formation positions of the first projecting part and the second projecting part of adjacent first and second terminal fittings among the plurality of terminal fittings are not aligned in the front-rear direction.

2. The connector according to claim 1, wherein the terminal fittings are arranged such that the first terminal fitting in which the first projecting part is formed on a front side in the front-rear direction and the second terminal fitting in which the second projecting part is formed on a rear side in the front-rear direction are adjacent, and the second projecting part of the second terminal fitting is inclined inward in the width direction toward a front side.

3. The connector according to claim 1, wherein the terminal fittings are arranged such that the first terminal fitting in which the first projecting part is formed on a front side in the front-rear direction and the second terminal fitting in which the second projecting part is formed on a rear side in the front-rear direction are adjacent, a plurality of housing recessed parts that are continuous with rear ends of the press-fit holes, respectively and are open at a rear surface of the housing are formed in the housing, the first projecting part of the first terminal fitting is housed in a corresponding housing recessed part among the plurality of recessed parts, an abutting part housed in the corresponding housing recessed part and having a shape projecting in the width direction is formed on the second shaft part of the second terminal fitting, and the abutting part is inclined inward in the width direction from an inner side of the corresponding housing recessed part toward an opening side of the corresponding housing recessed part.

4. The connector according to claim 2, wherein a step portion is formed with each of the plurality of press-fit holes of the housing.

5. The connector according to claim 4, wherein the step portion includes a regulating surface that is orthogonal to a press-fitting direction of each of the first terminal fitting and the second terminal fitting, and the regulating surface is configured to regulate a movement of each of the first terminal fitting and the second terminal fitting in the press-fitting direction.

* * * * *